US005751313A

United States Patent [19]

Miyashita et al.

[11] Patent Number: 5,751,313

[45] Date of Patent: May 12, 1998

[54] HYDROPHILIC INK PASSAGE

[75] Inventors: Satoru Miyashita; Kiyohiko Takemoto, both of Suwa, Japan

[73] Assignee: Seiko Epson Corporation, Tokyo-to, Japan

[21] Appl. No.: 376,304

[22] Filed: Jan. 23, 1995

Related U.S. Application Data

[63] Continuation of Ser. No. 941,034, filed as PCT/JP92/00108, Feb. 4, 1992, published as WO92/13719, Aug. 20, 1992, abandoned.

[30] Foreign Application Priority Data

| | | | |
|---|---|---|---|
| Feb. 4, 1991 | [JP] | Japan | 3-13272 |
| Mar. 1, 1991 | [JP] | Japan | 3-36049 |
| Apr. 16, 1991 | [JP] | Japan | 3-83747 |
| Jun. 18, 1991 | [JP] | Japan | 3-145950 |
| Nov. 7, 1991 | [JP] | Japan | 3-291659 |

[51] Int. Cl.[6] ..... B41J 2/19

[52] U.S. Cl. ..... 347/45; 347/92; 427/230; 427/372.2

[58] Field of Search ..... 347/44, 45, 64, 347/65, 85, 86, 92; 427/230, 372.2, 384, 389.7, 393.5, 393.6

[56] References Cited

U.S. PATENT DOCUMENTS

| | | | |
|---|---|---|---|
| 3,956,569 | 5/1976 | Jyo et al. | 427/180 |
| 4,725,862 | 2/1988 | Matsuzaki | 347/45 |
| 4,947,184 | 8/1990 | Moynihan | 347/45 |
| 5,141,822 | 8/1992 | Matsuo et al. | 428/623 |
| 5,144,340 | 9/1992 | Hotomi et al. | 346/140 R |
| 5,175,027 | 12/1992 | Holmes-Farley et al. | 427/393.5 X |

FOREIGN PATENT DOCUMENTS

| | | |
|---|---|---|
| 63-197650 | 8/1988 | Japan . |
| 63-222859 | 9/1988 | Japan . |
| 1-123752 | 5/1989 | Japan . |
| 1-159253 | 6/1989 | Japan . |
| 2-80252 | 3/1990 | Japan . |

*Primary Examiner*—Alrick Bobb
*Attorney, Agent, or Firm*—Ladas & Parry

[57] ABSTRACT

The present invention relates to an ink passage having surface which has a film comprising a fine particle of an inorganic oxide having a hydrophilic group. The surface of the ink passage according to the present invention has a high hydrophilicity and can rapidly remove bubbles formed within the ink passage. The recording head according to the present invention need not conduct filling of a liquid in the course of transportation and can be transported in an empty state.

16 Claims, 1 Drawing Sheet

HYDROPHILIC INK PASSAGE

This is a continuation of application Ser. No. 07/941,034 filed on Sep. 30, 1992, now abandoned and International Application PCT/JP92/00108 published as WO92/13719, Aug. 20, 1992, filed on Feb. 4, 1992 and which is designated the U.S.

BACKGROUND OF THE INVENTION

1. Technical Field

The present invention relates to an ink passage having a hydrophilic surface, for example, an ink jet recording head wherein the portion which contacts with an ink is hydrophilic.

2. Background Art

In an ink jet recording method, bubbles formed within an ink passage cause problems such as omission of dots or disturbance of printing. Therefore, the filling of ink should be conducted in such a manner that no bubble forms within the ink passage. It is preferred for bubbles, once formed, to be rapidly removed through a discharge operation.

In many cases, however, it is difficult to discharge bubbles formed within the passage. This is considered attributable to a poor wettability of the surface of the ink passage with a water-based ink due to a high water repellency of the surface of the ink passage which contacts with an ink. In particular, when a resin which can advantageously lower the production cost by virtue of its ease of processing and fabrication in comparison with glass and metals is used as an ink passage material including a recording head, the water repellency of the resin is so high that the formed bubbles are scarcely discharged.

For this reason, several proposals have been made for a method of enhancing the hydrophilicity of the internal surface of the ink passage. For example, there is a method wherein a polar group is formed on the surface of a resin constituting an ink passage by an acid treatment, a plasma treatment, etc. to impart a hydrophilicity to the surface of the resin (Japanese Patent Laid-Open Publication No. 24957/1985). This method, however, had a problem that the formed polar group is poor in persistence. Further, when the passage was allowed to stand for a long period of time in a state with no ink filling the passage, the effect of imparting the hydrophilic nature is lost. Therefore, when a recording head is produced, stored or transported, it is necessary to fill a liquid, e.g. an ink, for maintaining the polar group. The filling operation of the ink or other liquid during storage or transportation is troublesome. In addition to the above methods, a method wherein a dye is previously brought into contact with the ink passage with heating to make the surface of the passage compatible with the ink is known in the art (Japanese Patent Publication No. 54784/1990). However, this method as well has a problem of the persistence of the effect. Further, in some cases, the heating unfavorably gives rise to an enhancement in the water repellency of the resin.

SUMMARY OF THE INVENTION

Accordingly, an object of the present invention is to provide an ink passage having a hydrophilic surface.

Another object of the present invention is to provide an ink passage wherein formed bubbles can be rapidly removed.

A further object of the present invention is to provide an ink passage, especially an ink jet recording head, which can maintain a good hydrophilicity even when the inside of the head is emptied in a period between the production and the use of the head or during interruption of the use.

The ink passage according to the present invention comprises a passage having a surface which has a film comprising fine particles of an inorganic oxide having a hydrophilic group.

The process for producing an ink passage according to the present invention comprises coating a sol containing fine particles of an inorganic oxide on a base material and drying the coating.

DETAILED DESCRIPTION OF THE INVENTION

Ink Passage

Figure 1:
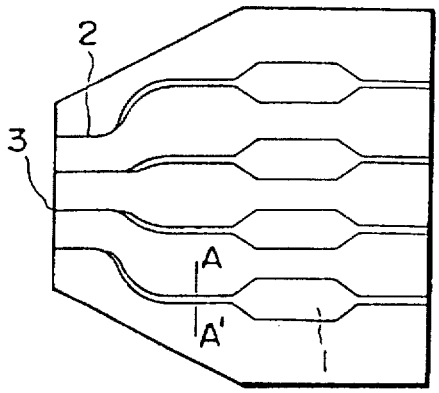
FIG. 1 is a schematic view of an ink jet recording head.

The term "ink passage" used herein is intended to mean a portion which comes into contact with an ink. For example, in the ink jet recording method, the ink passage refers to all the portions which contact with an ink in a path from a member for storing an ink through an ink feed system to a recording head. Therefore, in this specification, the recording head as well is referred to as "ink passage".

The ink passage according to the present invention has on its surface a film comprising fine particles of an inorganic oxide. The term "fine particles of an inorganic oxide" used herein is intended to mean fine particles of an inorganic element having on its surface a hydrophilic group such as a hydroxyl group, a carboxyl group or a sulfonyl group.

This film comprising fine particles of an inorganic oxide exhibits a very high hydrophilicity by virtue of the presence of the hydrophilic group on the surface of the fine particles of an inorganic oxide. This enables a high hydrophilicity to be imparted to the surface of the ink passage through the formation of this film on the surface of the ink passage. When the surface of the ink passage has a high hydrophilicity, bubbles formed within the ink passage are rapidly discharged without staying within the passage.

The surface of the ink passage according to the present invention has a high hydrophilicity and a contact angle of about 0° to 40°, preferably 0° to 30°.

The hydrophilic group on the surface of the fine particle of an inorganic oxide does not easily fall off and has an excellent persistence. For example, in a recording head subjected to a treatment for imparting a hydrophilic nature by the conventional method, it was necessary to fill the inside of the head with an ink or other liquid after the production of the head for allowing the hydrophilicity to persist until the recording head was used. By contrast, the recording head according to the present invention advantageously needs no filling material for maintaining the hydrophilicity. Further, the ink passage according to the present invention can maintain the hydrophilicity even when the ink is withdrawn and the recording head is exposed to the air for a long period of time. This as well is an advantage of the present invention unattainable by the conventional treatment method for imparting a hydrophilic nature.

Preferred examples of the fine particle of an inorganic oxide include fine particles composed mainly of an oxide of one or two or more elements selected from aluminum, zirconium, silicon, titanium, tin, indium, zinc, lead, germanium, hafnium, chromium, copper, iron, cobalt, nickel, manganese, vanadium, niobium, tantalum and molybdenum. The term "oxide of two or more elements" used herein is intended to include a mixture of oxides of a plurality of single inorganic elements (for example, an amorphous substance such as glass) and further an oxide wherein two or more elements selected from the above inorganic elements are stoichiometrically bonded to oxygen. It is also possible to add sodium and boron as a further component to these oxides.

Still preferred examples of the inorganic oxide include $Al_2O_3$, $ZrO_2$, $SiO_2$, $TiO_2$, $SnO_2$, $In_2O_3$, ZnO, PbO, $GeO_2$, $HfO_2$, $Cr_2O_3$, CuO, $Fe_2O_3$, CoO, NiO, $MnO_2$, $V_2O_5$, $Nb_2O_5$, $Ta_2O_5$ and $Mo_2O_5$. Preferred examples of the mixture of these inorganic oxides include $SiO_2$—$ZrO_2$-based glass compositions known as a zirconia glass (for example, $SiO_2$—$ZrO_2$, $SiO_2$—$ZrO_2$—$Al_2O_3$ and $SiO_2$—$ZrO_2$—$Na_2O$), $BaTiO_3$, $MgAl_2O_4$, ferrites (for example, Mn-ferrite, Co-ferrite and Mg-ferrite). In particular, since the zirconia glass has an alkaline resistance, the use of the zirconia glass is advantageous when the water-based ink is alkaline.

Although there is no particular limitation on the size of the fine particles of the inorganic oxide, the mean particle diameter is preferably 50 Å to 10 μm, still preferably 100 Å to 0.1 μm. When the mean particle diameter exceeds 10 μm, there is a possibility that the homogeneity of the sol is spoiled. Further, the film forming property as well is unfavorably poor. The particle shape as well is not particularly limited, and use may be made of particles having various shapes such as sphere and rod.

Although the thickness of the film comprising fine particles of an inorganic oxide can be properly determined by taking the degree of hydrophilicity, the necessary durability, etc. into consideration, it is preferably 50 Å to 10 μm, still preferably about 800 Å to 1 μm. The hydrophilic effect can be attained even when the film thickness exceeds the above range. In this case, however, the dimensional accuracy deteriorates and this is unfavorably causative of clogging.

The film comprising the fine particles of an inorganic oxide can be formed on various base materials for an ink passage. Preferred examples of the base material include glass, silicon, resins (for example, polysulfone, polycarbonate, polyethersulfone, photosensitive acrylic resin, amorphous polyolefin, polystyrene, epoxy resin, phenolic resin and acetal resin), metals (for example, chromium, stainless steel, gold, tantalum and aluminum), ceramics (alumina, PZT, silicon nitride, etc.) and metallic compounds ($SnO_2$, ITO, Ta—Al, Ta—N, etc.). Further, the base material may comprise a composite material. For example, an ink passage comprising a base material comprised of a substrate and a resin layer provided thereon (Japanese Patent Publication No. 59873/1987) and, formed on the substrate and the resin layer, a film comprising the above fine particles of an inorganic oxide is embraced in the present invention.

In the film comprising fine particles of an inorganic oxide, it is estimated that fine particles themselves or the fine particles and the surface of the base material are bonded to each other by van der Waals force, Coulomb's force and, in some cases, a hydrogen bond through a bond of hydrophilic groups present on each surface. When the base material is a resin, the film may be physically bonded to the base material by partial fusing.

Further, in order to make these bonds more firm, it is preferred to conduct the bonding through a coupling agent. For example, it is possible to utilize a silyl compound having, for example, an amino group, an alkoxy group, a hydroxyl group, an epoxy group, a vinyl group, a carbonyl group, a sulfonyl group or other group. In particular, the use of an aminosilane as the coupling agent is preferred because the bonding between the fine particles themselves and the bonding between the fine particles and the surface of the base material are both reinforced.

Figure 2:
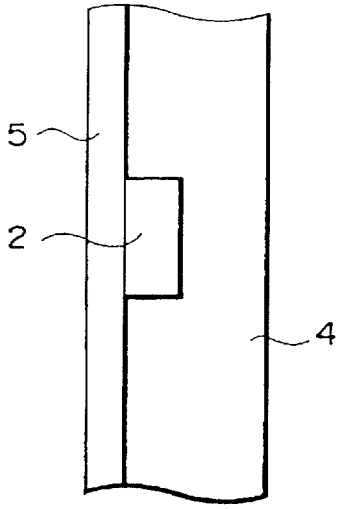
FIG. 2 is an enlarged cross section taken on line A–A' of FIG. 1.
Figure 3:
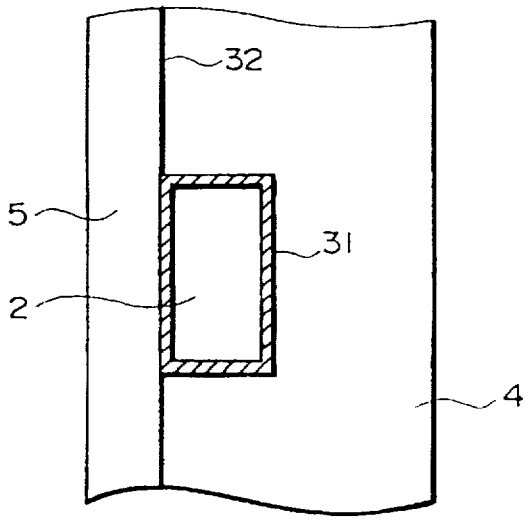
FIG. 3 is an enlarged view of the vicinity of a passage of an ink jet recording head according to the present invention.

The recording head (as described above, the, recording head as well is part of the ink passage) according to the present invention will now be described with reference to the accompanying drawings. FIG. 1 is a schematic view of an ink jet recording head. In the drawing, numeral 1 indicates a pressure chamber for obtaining a pressure used in the ejection of an ink by means of a PZT element or a heating element. The pressurized ink is passed through a path 2 and jetted through an ink jet nozzle 3. FIG. 2 is an enlarged cross section taken on line A–A' of FIG. 1. The recording head is formed by laminating a first substrate 4 having a pattern groove for passing of an ink and a second substrate 5 having no groove. FIG. 3 is an enlarged view of a portion corresponding to line A–A' of FIG. 1. A film 31 comprising fine particles of an inorganic oxide is formed on the whole internal surface of the ink path 2. Further, a film comprising fine particles of an inorganic oxide is provided also on the internal surface of the pressure chamber 1. This imparts a hydrophilic nature to a recording head at the whole ink passage which contacts with an ink, and when bubbles are formed, they are rapidly discharged. Numeral 32 designates an area of bond between the first substrate and the second substrate.

Production of Film Comprising Fine Particles of Inorganic Oxide

The ink passage according to the present invention can be produced by dispersing fine particles of an inorganic oxide in a suitable solvent to give a sol, coating the sol on the surface of the ink passage and drying the coating.

The sol containing fine particles of an inorganic oxide dispersed therein may be a commercially available one. Examples of the sol include those commercially available from Nissan Chemical Industries, Ltd. such as Snowtex (trade name) 20, 30, 40, C, N, 0, S, 20L and 0L (which are each a silica sol), alumina sol-100, 200 and 520 (which are each an alumina sol) and zirconia sol NZS-20A, 30A and 30B (which are each a zirconia sol).

It is also possible to utilize fine particles of an inorganic oxide produced by methods described in known documents. With respect to the known methods, reference may be made to Werner Stober et al., Journal of Colloid and Interface Science 26, 62–69 (1968) for $SiO_2$; Yoldas, Ceramic Bulletin 54, 289–290 (1957) for $Al_2O_3$; Hagiwara et al., Proceeding of Annual Meeting (1991) of The Ceramic Society of Japan, 2E02, 313 (1991) for $Al_2O_3$—$ZrO_2$-based oxide and $Al_2O_3$-$SiO_2$-based oxide; Ikemoto et al., Journal of The Ceramic Society of Japan, 93, 261–266 (1985) and E. A. Barringer et al., J. Am. Chem. Soc., 65, C199–201 (1982) for $TiO_2$, etc. The contents of these documents are herein incorporated by reference.

The synthesized fine particles of an inorganic oxide is dispersed in a suitable solvent to prepare a sol. The solvent as a dispersing medium may be selected from a wide variety of organic solvents which have a high wettability with the material constituting the surface of the ink passage and do not erode the base material. Preferred examples of the dispersing medium include monohydric alcohols such as methanol, ethanol, propanol, butanol and ethoxyethanol, polyhydric alcohols such as ethylene glycol and glycerin, amines such as triethylamine and pyridine, carboxylic acids such as formic acid, acetic acid and oxalic acid, acetonitrile and mixed solvents comprising mixtures of the above dispersing media, and mixed solvents comprising a mixture of the above dispersing media with water or other organic solvents. When the base material is a resin, lower alcohols are particularly preferred.

In some cases, the commercially available sol may be further diluted with a suitable solvent prior to use. The above solvents may be preferably used as a solvent in this case as well.

The amount of the fine particles of an inorganic oxide in the sol is preferably about 0.01 to 10% by weight, still preferably about 0.05 to 2% by weight. When the amount is less than 0.01% by weight, there is a possibility that no homogeneous coating can be attained. On the other hand, when the amount exceeds 10% by weight, this is unfavorably causative of clogging of the passage.

In the sol, it is also possible to add a suitable third component for the purpose of improving and stabilizing the dispersion of the fine particle of an inorganic oxide or to impart an electric charge to the surface of the fine particle. For example, it is preferred to add a surfactant in an amount of about 0.001 to 1% by weight.

When a coupling agent is added to a sol for the purpose of strengthening the bond between the fine particle of an inorganic oxide and the base material, the amount of addition is preferably about 0.001 to 1% by weight. When the amount of addition is less than 0.001% by weight, no effect of addition of the coupling agent is attained. On the other hand, when the amount of addition exceeds 1% by weight, there is a possibility that the stability of the sol per se is spoiled.

The sol thus prepared is applied to an ink passage. There is no particular limitation on the method of applying the sol to the ink passage so far as a layer of the sol can be evenly formed on the surface of the ink passage. However, the application of the sol by coating, dipping, spin coating, etc. is preferred. Further, the coating may be conducted by assembling a recording head as shown in FIG. 1, injecting a sol into the ink passage while applying suction by means of a pump or the like and removing excess sol through empty suction.

The thickness of the sol layer may be determined by taking the thickness of the film of fine particles of an inorganic oxide into consideration.

After the sol is applied to the surface of the ink passage, the sol is dried. The drying may be conducted at a temperature or above capable of evaporating the dispersing medium. For example, a film comprising fine particle of an inorganic oxide having a strength satisfactory for practical use can be formed within the ink passage by drying at a temperature of about 80° C.

According to a preferred embodiment of the present invention, the drying is conducted by heating to a temperature necessary for removing water physically adsorbed between fine particles of an inorganic oxide (hereinafter referred to as "temperature necessary for removing physically adsorbed water"). In the heating to at least a temperature necessary for removing physically adsorbed water, a chemical bond by means of a dehydrocondensation or a hydrogen bond in which no adsorbed water participates is formed, etc. are formed between the fine particles themselves and between the base material and the fine particles, which contributes to an improvement in the strength of the film comprising the fine particles of an inorganic oxide. The temperature for removing physically adsorbed water of the fine particles of an inorganic oxide can be determined, for example, from an endothermic peak obtained by a differential thermal analysis. This temperature varies depending upon the size of the fine particles. The smaller the particle diameter, the smaller the diameter of the pore between fine particles and consequently the higher the temperature for removing physically adsorbed water. Further, with respect to the fine particle shape, there is a tendency that the temperature for removing physically adsorbed water in the case of the spherical shape is higher than that in the case of a feathery or fibrous shape. The temperature for removing physically adsorbed water of the fine particles of an inorganic oxide utilized in the present invention is generally considered to be about 110° to 200° C.

According to another preferred embodiment of the present invention, the drying is conducted by heating to a heat deformation temperature of the base material. When the base material comprises a resin or comprises a composite structure having a surface comprised of a resin, the drying is conducted by heating to a temperature in the range of from 50° C. to the heat deformation temperature of the resin. When the resin wherein a film comprising fine particles of an inorganic oxide is deposited on the surface thereof is heated, the film is fixed through fusion or the like, which contributes to an increase in the strength of bond of the film to the surface of the resin. The bonding strength can be improved by increasing the heating temperature. However, it is preferred to avoid heating to a temperature above the heat deformation temperature of the resin from the viewpoint of the accuracy of the form. Although there is no strict physical definition on the heat deformation temperature of the resin, in many cases, the heat deformation temperature generally refers to a temperature at which the resin is deformed under a load of 18.5 kg/cm$^2$. In the present specification as well, the term "heat deformation temperature" is intended to mean the temperature defined under this condition. Similarly, when the base material comprises glass or comprises a composite structure having a surface comprised of a resin, it is preferred to conduct the drying through heating to a temperature up to the glass transition point of the glass.

The present invention will now be described in more detail with reference to the following Examples.

EXAMPLE A1

(1) Preparation of Sol

A silica sol comprising fine particles of silicon dioxide having a mean particle diameter of 0.02 μm dispersed in a solvent composed mainly of ethanol to a concentration of 0.1% by weight was prepared as follows. Fine particles of silicon dioxide was prepared by stirring ethyl silicate in the presence of a basic catalyst (ammonia) in a mixed solvent comprising ethanol and water and allowing the mixture to stand for several days. The reaction mixture containing the fine particles of silicon dioxide was concentrated, and ethanol was added thereto to give a sol comprising a fine particle dispersed in a mixed solvent comprising 95% by weight of ethanol and 5% by weight of water.

(2) Production of Recording Head and its Evaluation

A first substrate and a second substrate each comprising a polysulfone resin were washed and dried, and these substrates comprising a polysulfone resin were joined to each other through a solvent cement, and the resultant laminate was heated at 80° C. for bonding.

The above-described silica sol was injected by means of a pump into the recording head while applying suction. Thereafter, excess sol was removed by empty suction to coat the sol on the surface of the polysulfone resin. The recording head was dried at 80° C., and the nozzle portion of the tip of the head was cut. In the recording head thus prepared, an about 0.2 μm-thick film comprising fine particles of silicon dioxide was formed on the whole surface of the passage which comes into contact with an ink. The vicinity of the passage of the cross section in this recording head was as shown in FIG. 3. In FIG. 3, numeral 31 designates a film of silicon dioxide and numeral 32 a bond area of a solvent cement.

This recording head was mounted on an ink jet recording device, and a printing test was conducted. As a result, neither omission of dot nor disturbance of printing occurred, and an excellent hydrophilic effect was confirmed within the head. The ink was withdrawn from the ink jet recording head, the recording head was allowed to stand at 70° C. for 5 days, and a bubble discharge test was conducted. Specifically, an ink was sucked at a suction rate of 0.1 ml/sec for a given period of time, and printing was then conducted to determine a time taken for the bubbles remaining within the passage to be completely discharged and troubles such as omission of dot and disturbance of printing to be eliminated. As a result, these troubles could be completely eliminated in a suction time of 1 to 5 sec. Specifically, it was confirmed that the hydrophilic effect was maintained without deterioration and the bubbles formed within the ink passage could be easily removed by a simple discharge operation.

EXAMPLE A2

(1) Preparation of Sol

An alumina sol comprising fine particles of alumina having a mean particle diameter of 0.05 μm dispersed in a solvent composed mainly of propanol to a concentration of 0.2% by weight was prepared as follows. The fine particles of alumina were prepared by heating aluminum tripropoxide in water to 75° C., stirring the mixture, adding hydrochloric acid to the mixture and allowing the mixture to stand at 80° C. for several days. The reaction mixture containing the fine particles of alumina was concentrated, and propanol was added thereto to give a sol comprising a fine particle dispersed in a mixed solvent comprising 90% by weight of propanol and 10% by weight of water.

(2) Production of Recording Head and its Evaluation

A first substrate and a second substrate each comprising a polycarbonate resin were washed and dried, and the portions to be jointed was masked by taping, resist or the like. The above-described alumina sol was coated on the surface of the polycarbonate resin by dipping or spin coating. The coating was dried at 100° C., and the mask was removed. These substrates comprising a polycarbonate resin were joined to each other through a solvent cement, and the resultant laminate was heated at 80° C. for bonding. Thereafter, the nozzle portion of the tip of the head was cut. In the recording head thus prepared, an about 0.5 μm-thick film comprising fine particles of alumina was formed on the whole surface of the passage which comes into contact with an ink.

This recording head was mounted on an ink jet recording device, and a printing test was conducted. As a result, neither omission of dot nor disturbance of printing occurred, and an excellent hydrophilic effect was confirmed within the head. The ink was withdrawn from the ink jet recording head, the recording head was allowed to stand at 70° C. for 5 days, and a bubble discharge test was conducted in the same manner as that of Example A1. As a result, it was confirmed that as with Example A1, the troubles could be completely eliminated in a suction time of 1 to 5 sec.

EXAMPLE A3

(1) Preparation of Sol

A titania sol comprising fine particles of titanium oxide having a mean particle diameter of 0.3 μm dispersed in a solvent composed mainly of ethanol to a concentration of 2% by weight was prepared as follows. The fine particles of titanium oxide were prepared by stirring titanium tetraethoxide in a mixed solvent comprising ethanol and water to conduct hydrolysis. The reaction mixture containing the fine particle of titanium oxide was concentrated, and ethanol and 2-ethoxyethanol were added thereto to give a sol comprising fine particles dispersed in a mixed solvent comprising 60% by weight of ethanol, 35% by weight of 2-ethoxyethanol and 5% by weight of water.

(2) Production of Recording Head and its Evaluation

A first substrate and a second substrate each comprising a polyethersulfone resin were washed, dried and jointed to each other through an epoxy adhesive, and the laminate was heated at 80° C. for bonding.

The above-described titania sol was injected by means of a pump into the recording head while applying suction. Thereafter, excess sol was removed by empty suction to apply the sol to the surface of the polyethersulfone resin. The recording head was dried at 80° C., and the nozzle portion of the tip of the head was cut. In the recording head thus prepared, an about 3 μm-thick film comprising fine particles of titanium dioxide was formed on the whole surface of the passage which comes into contact with an ink.

This recording head was mounted on an ink jet recording device, and a printing test was conducted. As a result, neither omission of dot nor disturbance of printing occurred, and an excellent hydrophilic effect was confirmed within the head. The ink was withdrawn from the ink jet recording head, the recording head was allowed to stand at 70° C. for 5 days, and a bubble discharge test was conducted in the same manner as that of Example A1. As a result, it was confirmed that as with Example A1, the troubles could be completely eliminated in a suction time of 1 to 5 sec.

EXAMPLE B1

(1) Preparation of Sol

A sol comprising fine particles of $SiO_2$—$ZrO_2$—$Al_2O_3$ ($SiO_2$:$ZrO_2$:$Al_2O_3$=70:20:10, weight ratio) having a mean particle diameter of 0.05 μm dispersed in a solvent composed mainly of acetonitrile to a concentration of 0.1% by weight was prepared as follows. The composite fine particle of silica-zirconia-alumina was prepared by refluxing ethyl silicate, zirconium tetrabutoxide and aluminum tributoxide in octanol, adding acetonitrile and water thereto and stirring the mixture to conduct hydrolysis. Then, the reaction mixture containing the above fine particles was concentrated, and acetonitrile was added thereto to give a sol comprising fine particles dispersed in a mixed solvent comprising 70% by weight of acetonitrile, 20% by weight of octanol and 10% by weight of other solvent.

(2) Production of Recording Head and its Evaluation

A recording head wherein film comprising fine particles of $SiO_2$—$ZrO_2$—$Al_2O_3$ was formed on the whole surface of the passage which comes into contact with an ink was prepared in the same manner as that of Example A2.

The recording head thus prepared had the same printing performance as that in Example A2, and bubbles formed within the ink passage could be easily removed. Further, no hydrophilic effect was lost even when the ink was heated to 70° C. and circulated through the recording head for two weeks.

EXAMPLE B2

(1) Preparation of Sol

A sol comprising fine particles of $SiO_2$—$ZrO_2$—$Na_2O$ ($SiO_2$:$ZrO_2$:$Na_2O$=70:25:5, weight ratio) having a mean particle diameter of 0.02 μm dispersed in a solvent composed mainly of methanol to a concentration of 2% by weight was prepared as follows. The composite fine particle dispersed in this sol was prepared by refluxing methyl silicate, zirconium tetramethoxide and sodium methoxide in methanol, adding acetonitrile and water and stirring the mixture to conduct hydrolysis. Then, the reaction mixture containing the above fine particles was concentrated, and ethanol was added thereto to give a sol comprising fine particles dispersed in a mixed solvent comprising 90% by weight of ethanol, 9% by weight of acetonitrile and 1% by weight of water.

(2) Production of Recording Head and its Evaluation

A recording head wherein a film comprising a fine particle of $SiO_2$—$ZrO_2$—$Na_2O$ was formed on the whole surface of the passage which comes into contact with an ink was prepared in the same manner as that of Example A1.

The recording head thus prepared had the same printing performance as that in Example A1, and bubbles formed within the ink passage could be easily removed. Further, no hydrophilic effect was lost even when the ink was heated to 70° C. and circulated through the recording head for two weeks.

EXAMPLE B3

(1) Preparation of Sol

A sol comprising zirconium oxide having a mean particle diameter of 0.02 μm dispersed in a solvent composed mainly of ethanol to a concentration of 0.5% by weight was prepared as follows. The fine particles of zirconium oxide was prepared by dissolving zirconium tetrabutoxide in butanol, adding acetonitrile, a cellulose surfactant and water and stirring the mixture to conduct hydrolysis. The reaction mixture containing the fine particles of titanium oxide was concentrated, and ethanol was added thereto to give a sol comprising fine particles dispersed in a mixed solvent comprising 95% by weight of ethanol, 3% by weight of butanol and 1% by weight of each of acetonitrile and water.

(2) Production of Recording Head and its Evaluation

A first substrate and a second substrate each comprising a polyethersulfone resin were washed, dried and jointed to each other through an epoxy adhesive, and the laminate was heated at 80° C. for bonding.

The above-described sol was injected by means of a pump into the recording head while applying suction. Thereafter, excess sol was removed by empty suction to apply the sol to the surface of the polyethersulfone resin. The recording head was dried at 80° C., and the nozzle portion of the tip of the head was cut. In the recording head thus prepared, an about 400 Å-thick film comprising fine particles of zirconium oxide was formed on the whole surface of the passage which comes into contact with an ink.

This recording head was mounted on an ink jet recording device, and a printing test was conducted in the same manner as that of Example A1. The results were substantially the same as those of Example A1. Further, no hydrophilic effect was lost even when the ink was heated to 70° C. and circulated through the recording head for two weeks.

EXAMPLE C1

(1) Preparation of Sol

A silica sol comprising fine particles of silica having a mean particle diameter of 0.01 μm (Snowtex manufactured by Nissan Chemical Industries, Ltd.) was diluted with methanol to a concentration of 1% by weight to give a sol.

(2) Evaluation of Bonding Strength

The silica sol prepared in the above item (1) was coated on a flat plate of a polysulfone resin (heat deformation temperature: 175° C.), and the coating was heated and dried at temperatures specified in Table 1 for one hour. The resin plate thus prepared was subjected to measurement of an initial contact angle of water and a contact angle of water after rubbing the resin plate 100 times with a silicone rubber in an ink or a pure water. The results were as shown in Table 1.

TABLE 1

| Treatment temp. | 130 | 140 | 150 | 160 | 170 | 180 |
|---|---|---|---|---|---|---|
| Initial contact angle | 10 | 10 | 10 | 10 | 15 | heat deformation |
| Contact angle after rubbing in ink | 75 | 50 | 40 | 20 | 15 | — |
| Contact angle after rubbing in pure water | 40 | 30 | 20 | 10 | 15 | — |

From the results, it is apparent that the treatment at a temperature of about 160° to 170° C. can provide a satisfactory film bonding strength.

As is apparent from the results of Example A1, the film subjected to a treatment at a temperature of 80° C. had a strength satisfactory for practical use. It is surprising that the film strength can be improved by a treatment at a temperature of about 160° to 170° C.

(3) Evaluation of Performance of Recording Head

A first substrate and a second substrate each comprising a polysulfone resin were washed and dried, and these substrates comprising a polysulfone resin were joined to each other through a solvent cement, and the resultant laminate was heated at 80° C. for bonding. Thereafter, the nozzle portion of the tip of the head was cut.

The above-described silica sol was injected by means of a pump into the recording head while applying suction to coat the sol on the surface of the polysulfone resin. The recording head was dried at 80° C. and then heat-treated at 160° C. for one hour. In the recording head thus prepared, an about 800 Å-thick film comprising fine particles of silicon oxide was formed on the whole surface of the passage which comes into contact with an ink.

This recording head was mounted on an ink jet recording device, and a printing test was conducted. As a result, neither omission of dot nor disturbance of printing occurred, and an excellent hydrophilic effect was confirmed within the head. The ink was withdrawn from the ink jet recording head, the recording head was allowed to stand at 70° C. for 5 days, and a bubble discharge test was conducted. Specifically, an ink was sucked at a suction rate of 0.1 ml/sec for a given period of time, and printing was then conducted to determine a time taken for the bubbles remaining within the passage to be completely discharged and troubles such as omission of dot and disturbance of printing to be eliminated. As a result, these troubles could be completely eliminated in a suction time of 1 to 5 sec. Thus, it was confirmed that the hydrophilic effect was maintained without deterioration and the bubbles formed within the ink passage could be easily removed by a simple discharge operation.

EXAMPLE C2

(1) Preparation of Sol

An alumina sol comprising fine particles of alumina having a mean particle diameter of 0.02 μm (Alumina Sol 520 manufactured by Nissan Chemical Industries, Ltd.) was diluted with ethanol to a concentration of 0.2% by weight to give a dilute sol.

(2) Evaluation of Bonding Strength

The alumina sol prepared in the above item (1) was coated on a flat plate of a polycarbonate resin (heat deformation temperature: 135° C.), and the coating was heated and dried at temperatures specified in Table 1 for one hour. The resin plate thus prepared was subjected to measurement of an initial contact angle of water and a contact angle of water after rubbing the resin plate 100 times with a silicone rubber in an ink or a pure water. The results were as shown in Table 2.

TABLE 2

| Treatment temp. | 90 | 100 | 110 | 120 | 130 | 140 |
|---|---|---|---|---|---|---|
| Initial contact angle | 10 | 15 | 15 | 20 | 20 | heat deformation |
| Contact angle after rubbing in ink | 40 | 30 | 25 | 20 | 20 | — |
| Contact angle after rubbing in pure water | 75 | 75 | 40 | 30 | 20 | — |

From the results, it is apparent that the treatment at a temperature of about 120° to 130° C. can provide a satisfactory film bonding strength.

As is apparent from the results of Example A2, the film subjected to a treatment at a temperature of 80° C. had a strength satisfactory for practical use. It is surprising that the film strength can be improved by a treatment at a temperature of about 120° to 130° C.

(3) Evaluation of Performance of Recording Head

A first substrate and a second substrate each comprising a polysulfone resin were washed and dried, and the portions to be bonded were masked by taping, resist or the like. The above-described sol was coated on the surface of the polycarbonate resin by dipping or spin coating. The coating was maintained at 125° C. for one hour, the mask was removed, and these substrates were jointed to each other through a solvent cement. The laminate was heated at 80° C. for bonding. Thereafter, the nozzle portion of the tip of the head was cut. In the recording head thus prepared, an about 0.4 μm-thick film comprising fine particles of alumina was formed on the whole surface of the passage which comes into contact with an ink.

This recording head was mounted on an ink jet recording device, and a printing test was conducted. As a result, neither omission of dot nor disturbance of printing occurred, and an excellent hydrophilic effect was confirmed within the head. Printing was continuously conducted at room temperature for 1000 hr. No printing failure was observed, and a good long-term reliability could be attained. The ink was withdrawn from the ink jet recording head, the recording head was allowed to stand at 70° C. for 5 days, and a bubble discharge test was conducted. Specifically, an ink was sucked at a suction rate of 0.1 ml/sec for a given period of time, and printing was then conducted to determine a time taken for the bubbles remaining within the passage to be completely discharged and troubles such as omission of dot and disturbance of printing to be eliminated. As a result, these troubles could be completely eliminated in a suction time of 1 to 5 sec. Specifically, it was confirmed that the hydrophilic effect was maintained without deterioration and the bubbles formed within the ink passage could be easily removed by a simple discharge operation.

EXAMPLE C3

(1) Preparation of Sol

A zirconia sol comprising zirconium oxide having a mean particle diameter of 0.07 μm (Zirconia Sol NZA-20A manufactured by Nissan Chemical Industries, Ltd.) was diluted with methanol to a concentration of 1% by weight to give a dilute sol.

(2) Evaluation of Bonding Strength

The sol prepared in the above item (1) was coated on a flat plate of a polyethersulfone resin (heat deformation temperature: 203° C.), and the coating was heated and dried at temperatures specified in Table 1 for one hour. The resin plate thus prepared was subjected to measurement of an initial contact angle of water and a contact angle of water after rubbing the resin plate 100 times with a silicone rubber in an ink or a pure water. The results were as shown in Table 3.

TABLE 2

| Treatment temp. | 160 | 170 | 180 | 190 | 200 | 210 |
|---|---|---|---|---|---|---|
| Initial contact angle | 20 | 25 | 25 | 30 | 30 | heat deformation |
| Contact angle after rubbing in ink | 40 | 35 | 25 | 30 | 30 | — |
| Contact angle after rubbing in pure water | 40 | 35 | 30 | 30 | 30 | — |

From the results, it is apparent that the treatment at a temperature of about 170° to 200° C. can provide a satisfactory film bonding strength.

As is apparent from the results of Example B3, the film subjected to a treatment at a temperature of 80° C. had a strength satisfactory for practical use. It is surprising that the film strength can be improved by a treatment at a temperature of about 170° to 200° C.

(3) Evaluation of Performance of Recording Head

A first substrate and a second substrate each comprising a polyethersulfone resin were washed and dried and then jointed to each other through an epoxy adhesive, and the laminate was heated at 80° C. for bonding.

The above-described sol was injected by means of a pump into the recording head while applying suction to coat the sol on the surface of the polyethersulfone resin. The recording head was dried at 80° C. and further maintained at 170° C. for one hour. Thereafter, the nozzle portion of the tip of the head was cut. In the recording head thus prepared, an about 0.2 μm-thick film comprising fine particles of zirconium dioxide was formed on the whole surface of the passage which comes into contact with an ink.

This recording head was mounted on an ink jet recording device, and a printing test was conducted in the same manner as that of Examples C1 and C2. the results were substantially the same as those of Examples C1 and C2.

EXAMPLE D1

(1) Preparation of Sol

A silica sol comprising fine particles of silicon dioxide having a mean particle diameter of 0.01 μm dispersed in a solvent composed mainly of methanol to a concentration of 1% by weight was prepared in substantially the same manner as that of Example A1.

The temperature for removing physically adsorbed water in this silica sol was 150° C. as measured by a differential thermal analysis.

(2) Evaluation of Bonding Strength

The sol prepared in the above item (1) was coated on a flat plate of a polysulfone resin, and the coated resin was heat-treated under conditions of temperatures and times specified in Table 4. Thus, a 1000 Å-thick silicon dioxide film was formed on the resin plate, and the contact angle of the film was 10°. The film strength was evaluated by a water flow test wherein the film is washed with water running at a rate of 10 m/sec for 10 min, and a tape peeling test wherein whether or not the film is peeled off by means of a tape (Scotch Tape (trade name) manufactured by Sumitomo 3M) is observed. The results are given in Table 4.

TABLE 4

| | | | | | |
|---|---|---|---|---|---|
| Heating temp. | 130 | 140 | 150 | 150 | 160 |
| Heating time | 1 | 1 | 1 | 3 | 1 |
| Thickness of film after washing with running water (Å) | 200 | 200 | 800 | 1000 | 1000 |
| Contact angle | 20 | 20 | 10 | 10 | 10 |
| Tape peeling | peeled | peeled | 200 | 1000 | 1000 |
| Contact angle | — | — | 20 | 10 | 10 |

From the results, it is apparent that the treatment at a temperature of about 150° to 160° C. can provide a satisfactory film bonding strength.

As is apparent from the results of Example A1, the film subjected to a treatment at a temperature of 80° C. had a strength satisfactory for practical use. It is surprising that the film strength can be improved by a treatment at a temperature of about 150° to 160° C.

(3) Evaluation of Performance of Recording Head

A first substrate and a second substrate each comprising a polysulfone resin were washed and dried, and these substrates comprising a polysulfone resin were joined to each other through a solvent cement, and the resultant laminate was heated at 80° C. for bonding. Thereafter, the nozzle portion of the tip of the head was cut.

The above-described silica sol was injected by means of a pump into the recording head while circulating to coat the sol on the surface of the polysulfone resin. The recording head was dried at 80° C. and heat-treated at 160° C. for one hour. In the recording head thus prepared, an about 800 Å-thick film comprising fine particles of silicon oxide was formed on the whole surface of the passage which comes into contact with an ink.

This recording head was mounted on an ink jet recording device, and a printing test was conducted. As a result, neither omission of dot nor disturbance of printing occurred, and an excellent hydrophilic effect was confirmed within the head. The ink was withdrawn from the ink jet recording head, the recording head was allowed to stand at 70° C. for 5 days, and a bubble discharge test was conducted. Specifically, an ink was sucked at a suction rate of 0.1 ml/sec for a given period of time, and printing was then conducted to determine a time taken for the bubbles remaining within the passage to be completely discharged and troubles such as omission of dot and disturbance of printing to be eliminated. As a result, these troubles could be completely eliminated in a suction time up to 30 sec. Thus, it was confirmed that the hydrophilic effect was maintained without deterioration and the bubbles formed within the ink passage could be easily removed by a simple discharge operation.

EXAMPLE D2

(1) Preparation of Sol

A sol comprising fine particles of alumina in a rod form (Alumina Sol 520 manufactured by Nissan Chemical Industries, Ltd.) was diluted with ethanol to a concentration of 0.2% by weight to give a dilute sol.

The temperature necessary for removing physically adsorbed water in this alumina sol was 120° C. as measured by a differential thermal analysis.

(2) Evaluation of Bonding Strength

The sol prepared in the above item (1) was coated on a flat plate of a polycarbonate resin, and the coated resin was heat-treated under conditions of temperatures and times specified in Table 5. Thus, a 1 μm-thick alumina film was formed on the resin plate, and the contact angle of the films was 15° to 20°. The film strength was evaluated by a water flow test and a tape peeling test in the same manner as that of Example D1. The results are given in Table 5.

TABLE 5

| | | | | | |
|---|---|---|---|---|---|
| Heating temp. | 110 | 120 | 120 | 120 | 130 |
| Heating time | 6 | 1 | 3 | 6 | 1 |
| Thickness of film after washing with running water (μm) | <0.1 | 0.2 | 0.5 | 1 | 1 |
| Contact angle | 30 | 20 | 20 | 20 | 20 |
| Tape peeling | peeled | <0.1 | 1 | 1 | 1 |
| Contact angle | — | 30 | 20 | 20 | 20 |

From the results, it is apparent that the treatment at a temperature of about 120° to 130° C. can provide a satisfactory film bonding strength.

As is apparent from the results of Example A2, the film subjected to a treatment at a temperature of 80° C. had a strength satisfactory for practical use. It is surprising that the film strength can be improved by a treatment at a temperature of about 120° to 130° C.

(3) Evaluation of Performance of Recording Head

A first substrate and a second substrate each comprising a polycarbonate resin were washed and dried, and the portions to be bonded were masked by taping, resist or the like. The above-described alumina sol was coated on the surface of the polycarbonate resin by dipping or spin coating. The coating was maintained at 120° C. for 6 hr to remove physically adsorbed water and, at the same time, to immobilize alumina particles. The mask was removed, and these substrates comprising a polycarbonate resin were joined to each other through a solvent cement, and the resultant laminate was heated at 80° C. for bonding. Thereafter, the nozzle portion of the tip of the head was cut. In the recording head thus prepared, an about 0.4 μm-thick film comprising fine particles of alumina was formed on the whole surface of the passage which comes into contact with an ink.

This recording head was mounted on an ink jet recording device, and a printing test was conducted. As a result, neither omission of dot nor disturbance of printing occurred, and an excellent hydrophilic effect was confirmed within the head. Printing was continuously conducted at room temperature for 1000 hr. No printing failure was observed, and a good long-term reliability could be attained. The ink was withdrawn from the ink jet recording head, the recording head was allowed to stand at 70° C. for 5 days, and a bubble discharge test was conducted. As a result, no trouble such as omission of dot or disturbance of printing occurred. Thus, it was confirmed that the hydrophilic effect was maintained without deterioration and the bubbles formed within the ink passage could be easily removed by a simple discharge operation.

EXAMPLE D3

(1) Preparation of Sol

A sol comprising fine particles of zirconia having a mean particle diameter of 0.02 μm dispersed in a solvent composed mainly of ethanol to a concentration of 0.05% by weight was prepared in the same manner as that of Example B3.

The temperature for removing physically adsorbed water in this sol was 170° C. as measured by a differential thermal analysis.

(2) Evaluation of Bonding Strength

The sol prepared in the above item (1) was coated on a flat plate of a polyethersulfone resin, and the coated resin was heat-treated under conditions of temperatures and times specified in Table 6. Thus, a 2 μm-thick film was formed on the resin plate, and the contact angle of the films was 20° to 25°. The film strength was evaluated by a water flow test and a tape peeling test in the same manner as that of Example D1. The results are given in Table 6.

TABLE 6

| | | | | | |
|---|---|---|---|---|---|
| Heating temp. | 150 | 160 | 170 | 170 | 180 |
| Heating time | 1 | 1 | 1 | 3 | 1 |
| Thickness of film after washing with running water (μm) | <0.1 | <0.1 | 1 | 2 | 2 |
| Contact angle | 40 | 30 | 25 | 25 | 25 |
| Tape peeling | peeled | peeled | 2 | 2 | 2 |
| Contact angle | — | — | 25 | 25 | 25 |

From the results, it is apparent that the treatment at a temperature of about 170° to 180° C. can provide a satisfactory film bonding strength.

As is apparent from the results of Example B3, the film subjected to a treatment at a temperature of 80° C. had a strength satisfactory for practical use. It is surprising that the film strength can be improved by a treatment at a temperature of about 170° to 180° C.

(3) Evaluation of Performance of Recording Head

A first substrate and a second substrate each comprising a polyethersulfone resin were washed and dried, and these substrates comprising a polyethersulfone resin were joined to each other through an epoxy adhesive, and the resultant laminate was heated at 80° C. for bonding.

The above-described sol was injected by means of a pump into the recording head while circulating to coat the sol on the surface of the polyethersulfone resin. The recording head was dried at 80° C. and then heat-treated at 180° C. for one hour. Thereafter, the nozzle portion of the tip of the head was cut. In the recording head thus prepared, an about 400 Å-thick film comprising fine particles of $ZrO_2$ was formed on the whole surface of the passage which comes into contact with an ink.

This recording head was mounted on an ink jet recording device, and a printing test was conducted in the same manner as that of Examples D1 and D2. The results were substantially the same as those of Examples D1 and D2.

EXAMPLE E1

(1) Preparation of Sol

Fine particles of silicon dioxide having a mean particle diameter of 0.01 μm (AEROSIL 200 manufactured by Nippon Aerosil Co., Ltd.) was dispersed in a mixed solvent comprising 50% by weight of ethanol and 50% by weight of 2-ethoxyethanol to a concentration of 1% by weight. To the dispersion was added 0.1% by weight of aminosilane (SILA-ACE S330 manufactured by Chisso Corporation) as a silane coupling agent.

(2) Production of Recording Head and its Evaluation

A first substrate and a second substrate each comprising a polysulfone resin were washed and dried, and these substrates comprising a polysulfone resin were joined to each other through a solvent cement, and the resultant laminate was heated at 80° C. for bonding.

The above-described silica sol was injected by means of a pump into the recording head while applying suction, and excess sol was then removed by empty suction. The recording head was dried at 80° C., and the nozzle portion of the tip of the head was cut. In the recording head thus prepared, an about 1 μm-thick film comprising fine particles of silicon dioxide was formed on the whole surface of the passage which comes into contact with an ink.

This recording head was mounted on an ink jet recording device, and a printing test was conducted. As a result, neither omission of dot nor disturbance of printing occurred, and an excellent hydrophilic effect was confirmed within the head. The ink was withdrawn from the ink jet recording head, the recording head was allowed to stand at 70° C. for 5 days, and a bubble discharge test was conducted. Specifically, an ink was sucked at a suction rate of 0.1 ml/sec for a given period of time, and printing was then conducted to determine a time taken for the bubbles remaining within the passage to be completely discharged and troubles such as omission of dot and disturbance of printing to be eliminated. As a result, these troubles could be completely eliminated in a suction time of 1 to 5 sec. Specifically, it was confirmed that the hydrophilic effect was maintained without deterioration and the bubbles formed within the ink passage could be easily removed by a simple discharge operation.

EXAMPLE E2

(1) Preparation of Sol

A sol comprising fine particles of alumina in a rod form having a mean particle diameter of 0.02 μm (Alumina Sol 520 manufactured by Nissan Chemical Industries, Ltd.) was diluted with methanol to a concentration of 0.5% by weight to give a dilute sol. To the dispersion was added 0.05% by weight of aminosilane (SH6020 manufactured by Toray Silicone Co., Ltd.) as a silane coupling agent.

(2) Production of Recording Head and its Evaluation

The above-described alumina sol was injected by means of a pump while applying suction into a recording head comprising a first substrate which comprises a stainless steel plate having a pattern groove comprising an acrylic photocuring resin for an ink passage and a second substrate comprising glass and chromium sputtered thereon, and excess sol was then removed by empty suction. The recording head was dried at 140° C. In the recording head thus prepared, an about 800 Å-thick film comprising fine particles of alumina was formed on the whole surface of the passage which comes into contact with an ink.

This recording head was mounted on an ink jet recording device, and a printing test was conducted. As a result, neither omission of dot nor disturbance of printing occurred, and an excellent hydrophilic effect was confirmed within the head. The ink was withdrawn from the ink jet recording head, the recording head was allowed to stand at 70° C. for 5 days, and a bubble discharge test was conducted in the same manner as that of Example A1. Specifically, an ink was sucked at a suction rate of 0.1 ml/sec for a given period of time, and printing was then conducted to determine a time taken for the bubbles remaining within the passage to be completely discharged and troubles such as omission of dot and disturbance of printing to be eliminated. As a result, these troubles could be completely eliminated in a suction time of 1 to 5 sec. Specifically, it was confirmed that the hydrophilic effect was maintained without deterioration and the bubbles formed within the ink passage could be easily removed by a simple discharge operation.

EXAMPLE E3

(1) Preparation of Sol

A sol comprising fine particles of zirconium oxide having a mean particle diameter of 0.07 μm (Zirconia Sol NZS-20A manufactured by Nissan Chemical Industries, Ltd.) was diluted with a solvent composed mainly of methanol to a concentration of 0.02% by weight, and 0.02% by weight γ-glycidoxypropyltrimethoxysilane was added thereto as a silane coupling agent.

(2) Production of Recording Head and its Evaluation

The above-described zirconia sol was injected by means of a pump while applying suction into a recording head comprising a first substrate which comprises a glass plate having a pattern groove comprising an acrylic photocuring resin for an ink passage and a second substrate comprising silicon and ITO sputtered thereon, and excess sol was then removed by empty suction. The recording head was dried at 120° C. In the recording head thus prepared, an about 0.2 μm-thick film comprising a fine particle of zirconia was formed on the whole surface of the passage which comes into contact with an ink.

This recording head was mounted on an ink jet recording device, and a printing test was conducted. As a result, neither omission of dot nor disturbance of printing occurred, and an excellent hydrophilic effect was confirmed within the head. The ink was withdrawn from the ink jet recording head, the recording head was allowed to stand at 70° C. for 5 days, and a bubble discharge test was conducted in the same manner as that of Example A1. Specifically, an ink was sucked at a suction rate of 0.1 ml/sec for a given period of time, and printing was then conducted to determine a time taken for the bubbles remaining within the passage to be completely discharged and troubles such as omission of dot and disturbance of printing to be eliminated. As a result, these troubles could be completely eliminated in a suction time of 1 to 5 sec. Specifically, it was confirmed that the hydrophilic effect was maintained without deterioration and the bubbles formed within the ink passage could be easily removed by a simple discharge operation.

We claim:

1. A process for coating a base material of an ink passage, said process comprising the steps of:

a) coating the base material with a sol comprising fine particles of an inorganic oxide dispersed therein thereby to form a resultant coating, and b) drying the resultant coating, said fine particles comprising an inorganic oxide having a hydrophilic group and being present in said coating in a size and an amount that impart sufficient hydrophilicity to the base material to cause rapid discharge of bubbles formed within the ink passage, wherein the base material comprises a resin, silicon, glass, a ceramic, a metal or a composite material, and the drying step (b) is conducted by heating the resultant coating to a heat deformation temperature of the base material.

2. A process for coating a base material of an ink passage according to claim 1, wherein the resultant coating comprises physically adsorbed water and the drying in step (b) is conducted by heating the resultant coating to at least a temperature necessary for removing the physically adsorbed water.

3. A process for coating a base material of an ink passage according to claim 1, wherein the sol further comprises a coupling agent.

4. A process for coating a base material of an ink passage according to claim 1, wherein the sol comprises a solvent as a dispersing medium, said solvent being composed mainly of an organic solvent.

5. A process as claim in claimed 1 wherein said resultant coating consists essentially of said fine particles.

6. A process as claim in claimed 5 wherein said fine particles are composed mainly of an oxide of at least one element selected from the group consisting of aluminum, zirconium, silicon, titanium, tin, indium, zinc, lead, germanium, hafnium, chromium, copper, iron, cobalt, nickel, manganese, vanadium, niobium, tantalum and molybdenum.

7. A process as claimed in claim 5 wherein the fine particles have a mean particle diameter of 50 Å to 10 μm.

8. A process as claimed in claim 5 wherein the film has a thickness of 50 Å to 10 μm.

9. An ink passage comprising a base material coated the process of claim 2.

10. An ink passage comprising a base material coated by the process of claim 3.

11. An ink passage comprising a base material coated by the process of claim 4.

12. An ink passage comprising a base material coated by the process of claim 5.

13. An ink passage comprising a base material coated by the process of claim 6.

14. An ink passage comprising a base material coated by the process of claim 7.

15. An ink passage comprising a base material coated by the process of claim 8.

16. An ink passage comprising a base material coated by the process of claim 1.

* * * * *